US009979128B2

(12) United States Patent
Zieman

(10) Patent No.: US 9,979,128 B2
(45) Date of Patent: May 22, 2018

(54) RADIAL CENTERING MECHANISM FOR FLOATING CONNECTION DEVICES

(71) Applicant: Cisco Technology, Inc., San Jose, CA (US)

(72) Inventor: Christopher Eugene Zieman, Chapel Hill, NC (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 35 days.

(21) Appl. No.: 14/620,187

(22) Filed: Feb. 12, 2015

(65) Prior Publication Data

US 2016/0240973 A1 Aug. 18, 2016

(51) Int. Cl.

| | |
|---|---|
| ***H01R 13/631*** | (2006.01) |
| ***H01R 13/66*** | (2006.01) |
| ***H01R 13/24*** | (2006.01) |
| *H01R 24/50* | (2011.01) |

(52) U.S. Cl.

CPC ..... *H01R 13/6315* (2013.01); *H01R 13/2421* (2013.01); *H01R 13/665* (2013.01); *H01R 24/50* (2013.01)

(58) Field of Classification Search

CPC .. H01R 13/6315; H01R 12/91; H01R 13/665; H01R 24/50; H01R 13/2421

USPC ..... 439/246, 247–249, 251, 252, 700

See application file for complete search history.

(56) References Cited

U.S. PATENT DOCUMENTS

| | | | | |
|---|---|---|---|---|
| 4,580,862 A * | 4/1986 | Johnson | H01R 24/52 | 439/248 |
| 5,769,652 A * | 6/1998 | Wider | H01R 24/50 | 439/248 |
| 6,152,743 A * | 11/2000 | Fox | H01R 24/42 | 439/620.03 |
| 6,699,054 B1 * | 3/2004 | Critelli | H01R 13/6315 | 439/248 |
| 6,908,347 B2 * | 6/2005 | Sasaki | H01R 13/2421 | 439/66 |
| 7,422,456 B1 * | 9/2008 | Mitani | H01R 13/6315 | 439/247 |
| 7,563,133 B2 * | 7/2009 | Stein | H01R 13/6271 | 439/248 |

(Continued)

*Primary Examiner* — Tulsidas C Patel
*Assistant Examiner* — Travis Chambers
(74) *Attorney, Agent, or Firm* — Ronald Fernando

(57) ABSTRACT

Previously available multiport connector pairings that use floating devices typically include relatively generous lead-in chamfers surrounding receiving ports in order to facilitate blind mating. As port density increases there is less room for lead-in chamfers, and in turn, blind mating becomes more challenging. By contrast, various implementations disclosed herein include multiport connection arrangements that include a floating connection device at least partially included within a port, and a radial centering mechanism arranged in combination with the floating connection device. The radial centering mechanism imparts a force that biases the floating connection device along the axis of the port. In some implementations, the radial centering mechanism imparts a substantially balanced axial force in order to bias the floating connection device. In some implementations, the radial centering mechanism imparts a substantially radial force in order to bias the floating connection device.

16 Claims, 6 Drawing Sheets

(56) References Cited

U.S. PATENT DOCUMENTS

| | | | | |
|---|---|---|---|---|
| 7,607,929 | B1 * | 10/2009 | Nguyen | H01R 13/6315 439/246 |
| 7,713,076 | B2 * | 5/2010 | Arts | H01R 13/748 439/248 |
| 7,857,669 | B1 * | 12/2010 | Wavering | H01R 13/6315 439/246 |
| 7,963,785 | B2 * | 6/2011 | Arts | H01R 13/6315 439/248 |
| 8,251,725 | B2 * | 8/2012 | Kasparian | H01R 13/187 439/252 |
| 9,039,433 | B2 * | 5/2015 | Barthelmes | H01R 12/91 439/248 |
| 2013/0005179 | A1 * | 1/2013 | Aldana | H01R 13/6315 439/529 |
| 2014/0073160 | A1 * | 3/2014 | Shinder-Lerner | H01R 24/50 439/246 |
| 2014/0120760 | A1 * | 5/2014 | Zieman | H01R 12/91 439/357 |
| 2015/0180150 | A1 * | 6/2015 | Shinder-Lerner | H01R 12/91 439/252 |
| 2016/0104969 | A1 * | 4/2016 | An | H01R 24/40 439/248 |
| 2016/0118736 | A1 * | 4/2016 | Hoyack | H01R 24/542 439/246 |

* cited by examiner

RADIAL CENTERING MECHANISM FOR FLOATING CONNECTION DEVICES

TECHNICAL FIELD

The present disclosure relates to multiport radio frequency (RF) connectors, and in particular, to enabling radial centering of densely packed floating connection devices.

BACKGROUND

The ongoing development of data networks often involves incorporating additional functionality into and enabling greater connectivity with a network node. This end can be pursued in part by increasing the number of ports included in a network node. As the number of ports increases, it is useful to group ports in order to produce a physically manageable interface, with a relatively compact form-factor.

One way to group ports is through a multiport RF connector. A multiport RF connector includes an array of ports housed in a machined or cast body. One of the more challenging assembly configurations in which to provide effective blind mating solutions includes a printed circuit board (PCB) having two or more multiport RF connectors, that each mate with a corresponding connector situated on a different one of two or more other PCBs. In such assembly configurations, each connector pairings is preferably configured to include some amount of radial float (or compliance). Radial float accommodates spacing tolerances, tolerance stack-up in the mechanical system, and offset biases between the various PCBs.

Some multiport RF connector pairings include floating connection devices anchored to at least one of the connectors of a pairing in order to provide radial float. Floating connection devices, such as floating bullets, enable less stringent sizing and spacing tolerances, greater accommodation of offset biases, and enable less rigid mating between two connectors. Previously available multiport RF connector pairings that utilize floating bullets also typically include relatively generous lead-in chamfers surrounding receiving ports. The lead-in chamfers function to gather floating bullets into port-to-port alignment when connectors are offset relative to one another in order to facilitate blind mating. However, as port density increases, there is less room for generous lead-in chamfers surrounding receiving ports, and in turn, blind mating becomes more challenging.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Figure 1:
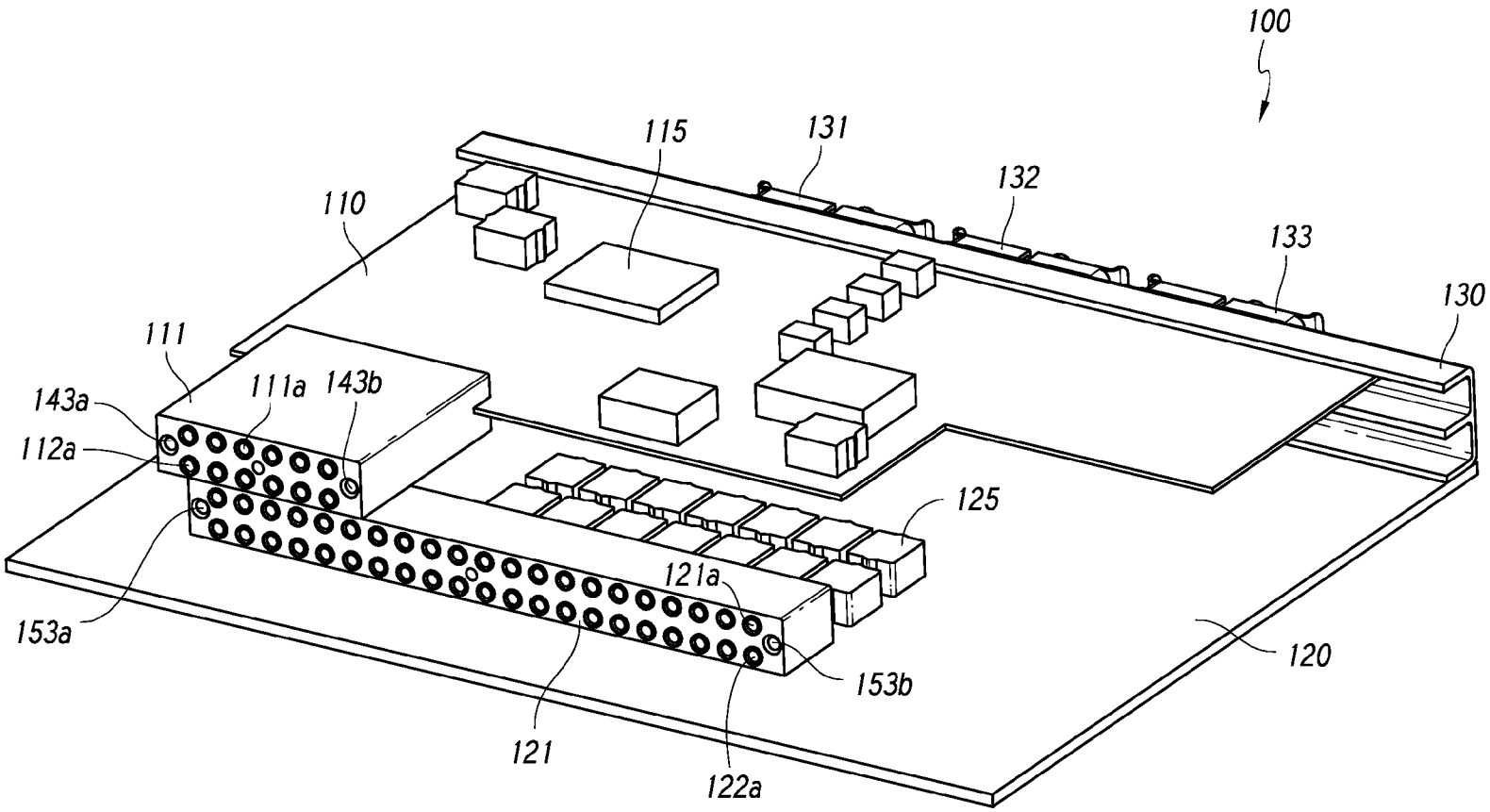
FIG. 1 is a perspective view of a multiport RF connection assembly in accordance with some implementations.

In accordance with common practice various features shown in the drawings may not be drawn to scale, as the dimensions of various features may be arbitrarily expanded or reduced for clarity. Moreover, the drawings may not depict all of the aspects and/or variants of a given system, method or apparatus admitted by the specification. Finally, like reference numerals are used to denote like features throughout the figures.

DESCRIPTION

Numerous details are described herein in order to provide a thorough understanding of illustrative implementations shown in the drawings. However, the drawings merely show example aspects of the present disclosure and are therefore not to be considered limiting. Those of ordinary skill in the art will appreciate from the present disclosure that other effective aspects and/or variants do not include all of the specific details described herein. Moreover, well-known systems, methods, components, devices and circuits have not been described in exhaustive detail so as not to unnecessarily obscure more pertinent aspects of the implementations described herein.

Overview

Previously available multiport connector pairings that use floating connection devices typically include relatively generous lead-in chamfers surrounding receiving ports in order to facilitate blind mating. As port density increases there is less room for lead-in chamfers, and in turn, blind mating becomes more challenging. By contrast, implementations disclosed herein include multiport connection arrangements that include a radial centering mechanism arranged in combination with a floating connection device in order to facilitate blind mating. In accordance with various implementations, a radial centering mechanism imparts a force that biases a floating connection device along a corresponding axial center line of a respective port. In some implementations, the radial centering mechanism imparts a substantially balanced axial force in order to bias the floating connection device. In some implementations, the radial centering mechanism imparts a substantially radial force in order to bias the floating connection device.

FIG. 1 is a perspective view of a multiport RF connection assembly 100 in accordance with some implementations. While certain specific features are illustrated, those skilled in the art will appreciate from the present disclosure that various other features have not been illustrated for the sake of brevity and so as not to obscure more pertinent aspects of the example implementations disclosed herein. To that end, the multiport RF connection assembly 100 includes a first PCB 110, a second PCB 120, and a mounting bracket 130.

The first and second PCBs 110, 120 are rigidly fixed to one another by the mounting bracket 130 along corresponding fixed edges. The first PCB 110 includes a first multiport RF connector 111 along an edge not fixed to the mounting bracket 130. Similarly, the second PCB 120 includes a second multiport RF connector 121 along an edge not fixed to the mounting bracket 130. In some implementations, the first and second multiport RF connectors 111, 121 are connected to the respective first and second PCBs 110, 120 in the same orientation as one another and along overlapping edges, as shown in FIG. 1. However, in other implementations, the first and second multiport RF connectors 111, 121 are connected to the respective first and second PCBs 110, 120 in different orientations and/or along different edges. Moreover, while FIG. 1 includes two multiport RF connectors included on two PCBs, those of ordinary skill in the art will appreciate from the present disclosure that a various implementations of multiport connection assemblies include any combination of one or more multiport RF connectors and one or more PCBs (or the like). Additionally, those of ordinary skill in the art will also appreciate from the present disclosure that a particular arrangement and/or orientations of two or more multiport RF connectors on one or more PCBs is at least partially determined by the arrangement of other components, as well as other physical constraints, such as form factor and connectivity specifications in one or more directions.

In some implementations, the mounting bracket 130 includes port-interfaces 131, 132, 133. The port-interfaces 131, 132, 133 are each configured to provide connectivity and/or power supply connections to at least one of the first and second PCBs 110, 120 and/or components included on or coupled to the first and second PCBs 110, 120. While three port-interfaces are shown in FIG. 1, those of ordinary skill in the art will appreciate from the present disclosure that such port-interfaces are optionally included on a mounting bracket (or the like), and that any number of one or more such port-interfaces are merely optionally included in a particular implementation.

Moreover, while first and second PCB 110, 120 are shown as an example of one implementation, those of ordinary skill in the art will also appreciate that various other implementations include any number of packaging and mounting substrates. In various implementations, a substrate includes at least one of a printed circuit board, a backplane and a port mounting plate. Those of ordinary skill in the art will also appreciate that conductive traces and components typically included on a PCB have not been illustrated for the sake of clarity and brevity. As an example only, the first PCB 110 includes a number of surface mount devices 115 shown merely to provide visual context. Similarly, the second PCB 120 also includes a number of surface mount devices 125 also shown merely to provide visual context.

Also, as an example, each of the first and second multiport RF connectors 111, 121 includes two rows of ports. Each port extends into and is routed through the body of a respective one of the multiport RF connector 111, 121. For example, a first row on the first multiport RF connector 111 includes port 111*a*, and a second row includes port 112*a*. Similarly, a first row on the second multiport RF connector 121 includes port 121*a*, and a second row includes port 122*a*. Moreover, while the first multiport RF connector 111 is illustrated having a total of twelve ports and the second multiport RF connector 121 is illustrated having a total of forty-two ports, those of ordinary skill in the art will appreciate that, in various implementations, a multiport RF connector includes any number of ports arranged in one or more rows or another suitable arrangement (e.g. a hexagonal pattern, a circular pattern, etc.).

Additionally, in some implementations, the first multiport RF connector 111 also includes apertures 143*a*, 143*b* for corresponding fasteners (not shown) used to support mechanical engagement between connectors. In some implementations, the second multiport RF connector 121 also includes similar apertures 153*a*, 153*b* for corresponding fasteners (again, not shown). Fasteners include, without limitation, at least one of a press-fit tab, a press-fit post, a barb, a screw, a spring, a nail, a staple and a rivet.

Figure 2:
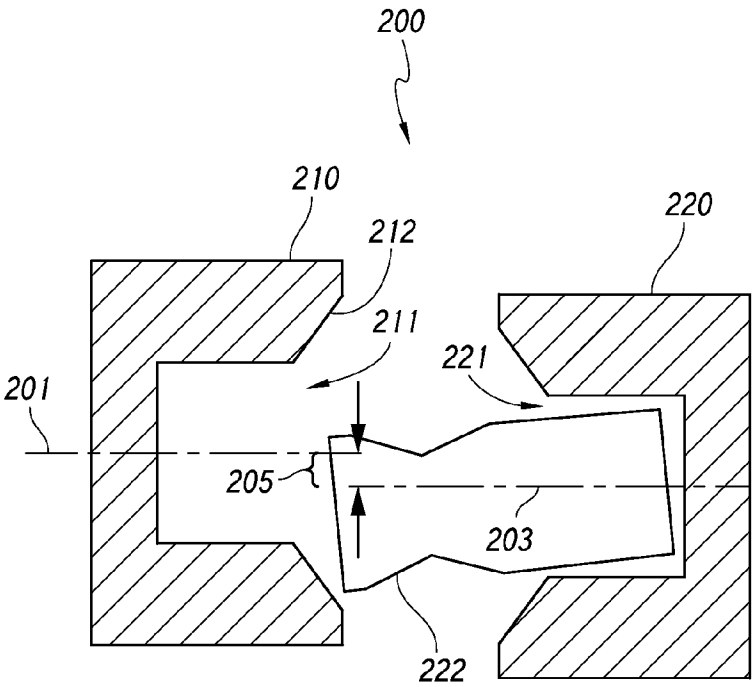
FIG. 2 is a cross-sectional view of a portion of a multiport RF connection assembly showing an isolated port-to-port pairing that includes a lead-in chamfer.

With continued reference to FIG. 1, FIG. 2 of a portion of a multiport RF connection assembly 200. To that end, the multiport RF connection assembly 200 includes first and second ports 211, 221 included in respective first and second housings 210, 220. Each of the first and second housings 210, 220 are included in respective multiport RF connectors that are mated to from a multiport connector pairing. While each of the first and second housings 210, 220 shown in FIG. 2 merely includes a single respective port, those of ordinary skill in the art will appreciate from the present disclosure that in various implementations a housing of a multiport connector includes a plurality of ports. In some implementations, each of the first and second ports 211, 221 is defined by a substantially cylindrical sidewall. Accordingly, the first port 211 is at least partially characterized by an axial center line 201, and the second port 221 is also at least partially characterized by an axial center line 203.

The second port 221 includes a floating bullet 222 (i.e., a floating connection device) that is anchored to the second port 221, and that is also able to float radially around the axial center line 203. The first port 211 includes a lead-in chamfer 212. The lead-in chamfer 212 is provided to guide the floating bullet 222 into alignment with the first port 211, in order to compensate for any misalignment 205 between the center liners 201, 203. During mating of the first and second ports 211, 221, when the lead-in chamfer 212 meets the floating bullet 222, the bevel of the lead-in chamfer 212 tilts the floating bullet 222 toward the axial center line 201 of the first port 211. In other words, the lead-in chamfer 212 gathers and repositions the floating bullet 222 to the correct position with respect to the mating interface when the center lines 201, 203 are initially misaligned.

Figure 3:
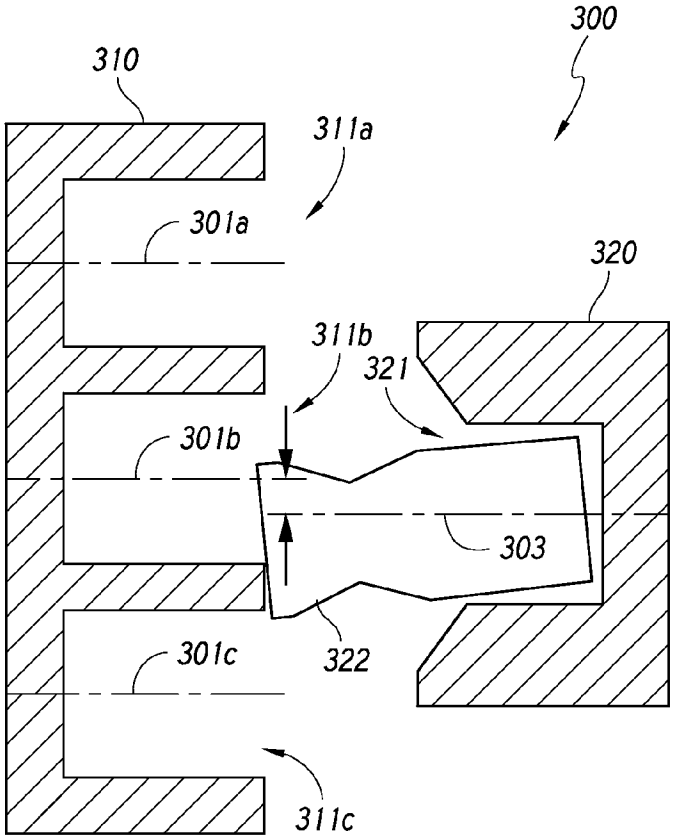
FIG. 3 is a cross-sectional view of a portion of a multiport RF connection assembly showing a misaligned port-to-port pairing without a lead-in chamfer.

However, as noted above, as the port density of a multiport RF connector increases, there is less room for generous lead-in chamfers surrounding receiving ports, and in turn, blind mating becomes more challenging. For example, FIG. 3 is a cross-sectional view of a portion of another multiport RF connection assembly 300 showing a misaligned port-to-port pairing without the aid of a generous lead-in chamfer. In particular, the multiport RF connection assembly 300 includes first and second housings 310, 320. As an example, the first housing 310 includes three ports 311*a*, 311*b*, 311*c* defined by sidewalls provided by the first housing 310. Each of the three ports 311*a*, 311*b*, 311*c* includes a respective axial center line 301*a*, 301*b*, 301*c*. However, due to the dense arrangement of the three ports 311*a*, 311*b*, 311*c*, there is no room for lead-in chamfers on the sidewalls provided by the first housing 310. The second housing 320 includes a port 321 that is at least partially characterized by an axial center line 303. The port 321 includes a floating bullet 322 (i.e., a floating connection device) that is anchored to the second port 321, and that is also able to float radially around the axial center line 303.

During mating of the port 311*b* and the 321, the floating bullet 322 will simply jam against the sidewall defining the port 311*b*. In such instances, without a lead-in chamfer, the floating bullet 322 can be damaged and/or may be forced into one of the adjacent ports 311*a*, 311*c*, and as a result, blind mating of multiport RF connectors is less reliable.

Figure 4:
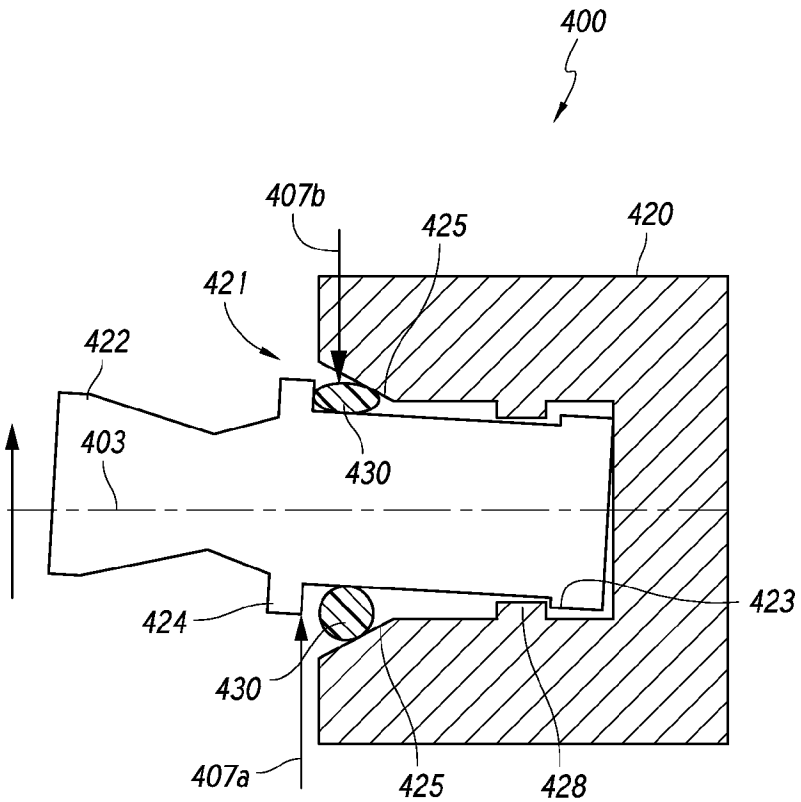
FIG. 4 is a cross-sectional view of a portion of a multiport RF connector showing a floating connection assembly enabled in accordance with some implementations.

By contrast, the various implementations described herein include a floating connection assembly having a radial centering mechanism that assists with blind mating of densely packed ports. As an illustrative example, FIG. 4 is a cross-sectional view of a portion of a multiport RF connector 400 including a floating connection assembly configured according to some implementations. While certain features are illustrated, those skilled in the art will appreciate from the present disclosure that various other features have not been illustrated for the sake of brevity and so as not to obscure more pertinent aspects of the example implementations disclosed herein.

As an illustrative example, the multiport connector 400 includes a port 421 included in a housing 420. While the housing 420 shown in FIG. 4 merely includes a single respective port in order to focus on pertinent features of various implementations, those of ordinary skill in the art will appreciate that in various implementations a housing of a multiport connector includes a plurality of ports. In some implementations, the port 421 is defined by a substantially cylindrical sidewall, which has a substantially circular radial cross-section. The port 421 is also at least partially characterized by an axial center line 403. In other words, the port 421 has a sidewall defined path and an axis substantially centered through the sidewall defined path. In various implementations, the port 421 has a radial cross-section that is not circular. For example, in some implementations the port 421 has, without limitation, a substantially ovular cross-section, a substantially square cross-section, a substantially rectangular cross-section, a hexagonal cross-section, or any other cross-sectional shape suitable for a particular implementations. Irrespective of the cross-sectional shape, a port may be at least partially characterized by an axial line that is substantially centered in at least one dimension for the purpose of blind mating.

In some implementations, the port 421 is included in a floating connection assembly that includes a floating bullet 422 and a radial centering mechanism 430. That is, the floating connection assembly includes a first port (e.g., port 421), a floating connection device (e.g., floating bullet 422) at least partially included within the first port, and a radial centering mechanism arranged in combination with the floating connection device. For example, in some implementations, the floating bullet 422 is anchored to the port 421, and is able to float radially around the axial center line 403 in order to provide radial compliance. In some implementations, the floating bullet 422 is anchored to the port 421 by the engagement of a first lip 423 on the floating bullet 422 and a circumferential ridge 428 protruding inward from the sidewall housing of the port 421. In some implementations, the first lip 423 surrounds at least a portion of the cross-sectional circumference of the floating bullet 422. In some implementations, the first lip 423 surrounds one or more circumferential portions of the floating bullet 422. In some implementations, the first lip 423 substantially surrounds the cross-sectional circumference of the floating bullet 422.

In some implementations, the radial centering mechanism 430 is arranged between a chamfer 425 (at the opening of the port 421) and a second lip 424 on the floating bullet 422. The second lip 424 is provided to help maintain engagement and position of the radial centering mechanism 430 between the chamfer 425 and the floating bullet 422. In some implementations, the second lip 424 surrounds at least a portion of the cross-sectional circumference of the floating bullet 422. In some implementations, the second lip 424 surrounds one or more circumferential portions of the floating bullet 422. In some implementations, the second lip 424 substantially surrounds the cross-sectional circumference of the floating bullet 422.

The radial centering mechanism 430 is arranged to impart a force that biases the floating bullet 422 along the axial center line 403 of the port 421. As shown in FIG. 4, in some implementations, the force—indicated by force lines 407*a*, 407*b*—is a substantially radial force that biases the floating bullet 422 along the axial center line 403. To that end, in some implementations for example, the radial centering mechanism 430 includes a deformable O-ring (or the like). A portion of the deformable O-ring deforms against a portion of the chamfer 425 in response to a force exerted against the floating bullet 422, and imparts a radial force in response that at least partially opposes the force exerted against the floating bullet 422. As a result, the radial force pushes the floating bullet 422 back towards the axial center line 403. In other words, the radial centering mechanism 430 repositions the floating bullet 422 to the correct position with respect to a mating interface.

Figure 5:
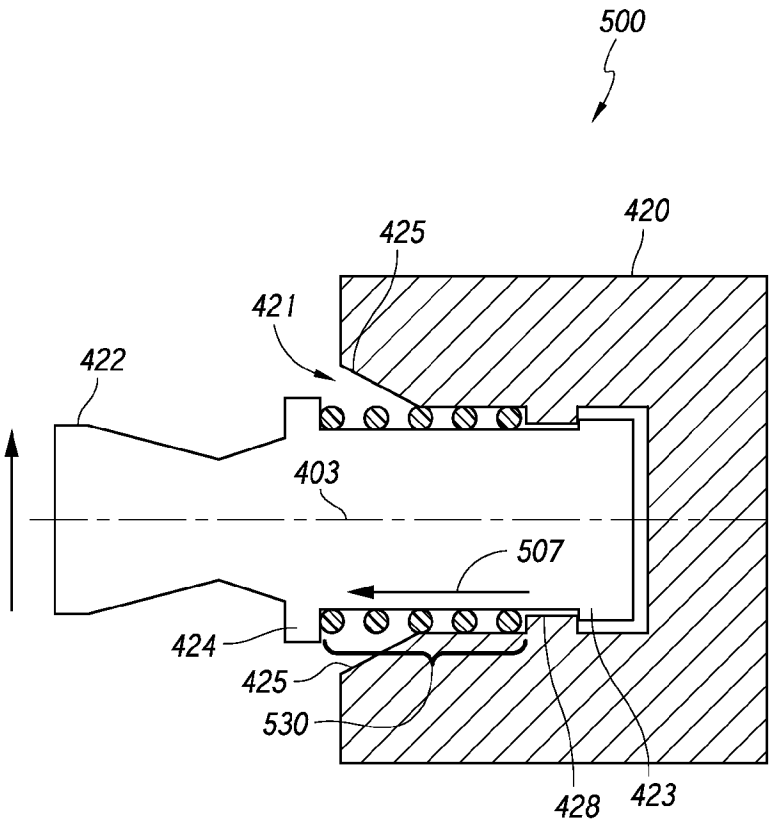
FIG. 5 is a cross-sectional view of a portion of a multiport RF connector showing a floating connection assembly enabled in accordance with some implementations.

FIG. 5 is a cross-sectional view of a portion of a multiport RF connector 500 showing a floating connection assembly configured according to some implementations. The multiport RF connector 500 shown in FIG. 5 is similar to an adapted from the multiport RF connector 400 provided in FIG. 4. Elements common to FIGS. 4 and 5 include common reference numbers, and only the differences between FIGS. 4 and 5 are described herein for the sake of brevity. To that end, the multiport RF connector 500, and in particular the radial centering mechanism 530, includes a spring (or elongate semi-rigid flexible sheath) between the second lip 424 of the floating bullet 422 and the circumferential ridge 428 on the inner sidewall housing of the port 421. In some implementations, the radial centering mechanism 530 includes a radial spring—an example of which is described below with reference to FIG. 8. In some implementations, the radial centering mechanism 530 includes an elongate semi-rigid, flexible sheath or tube that returns to a nominal shape along the axial center line 403—an example of which is described below with reference to FIG. 9.

In operation, the radial centering mechanism 530 is arranged to impart a force that biases the floating bullet 422 along the axial center line 403 of the port 421. However, in contrast to the radial centering mechanism 430 of FIG. 4, the radial centering mechanism 530 of FIG. 5 imparts a substantially balanced axial force in order to bias the floating bullet along the axial center line 403. The balanced axial force is generated by the deformation of the radial centering mechanism 530 in response to a force exerted against the floating bullet 422 that causes the radial centering mechanism 530 (surrounding a portion of the floating bullet 422) to initially deform away from the axial center line 403. As such, the balanced axial force pushes the floating bullet 422 back towards the axial center line 403, such that the radial centering mechanism 530 repositions the floating bullet 422 to the correct position with respect to a mating interface.

Figure 6:
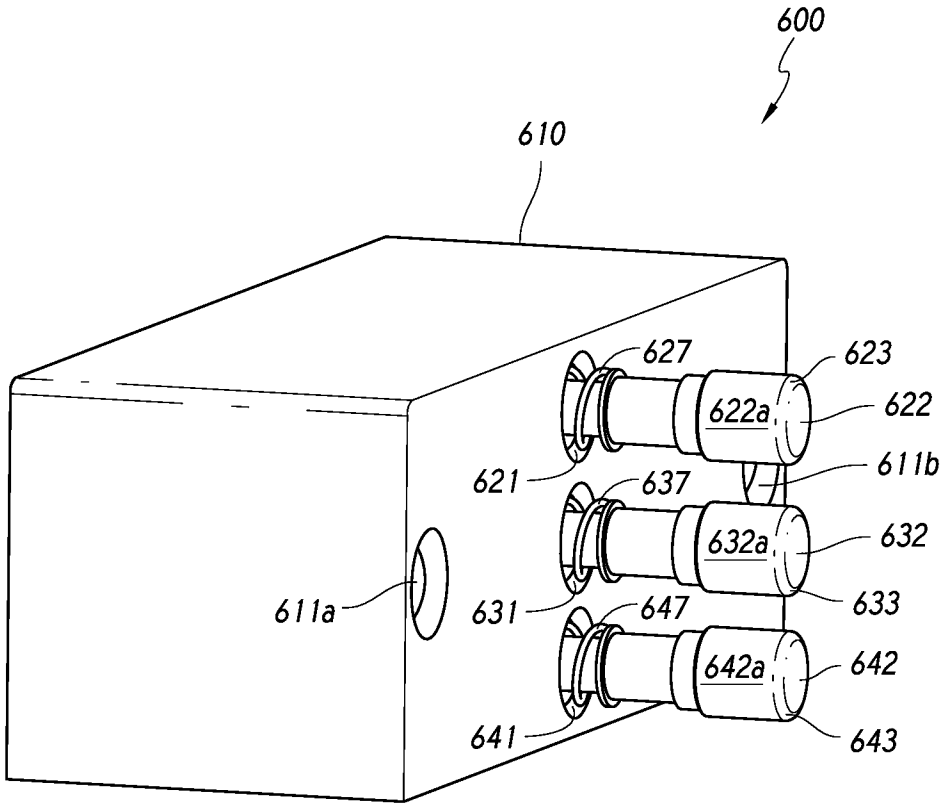
FIG. 6 is a perspective view of a multiport RF connector including floating connection devices enabled in accordance with some implementations.

FIG. 6 is a perspective view of a multiport RF connector 600 including a floating connection assembly configured according to some implementations. While certain specific features are illustrated, those skilled in the art will appreciate from the present disclosure that various other features have not been illustrated for the sake of brevity and so as not to obscure more pertinent aspects of the example implementations disclosed herein.

To that end, the multiport RF connector 600 includes a housing 610. The housing 610 includes apertures 611*a*, 611*b* for corresponding fasteners (not shown) used to support mechanical engagement between the multiport RF connector 600 and a complementary mating connector (not shown). Fasteners include, without limitation, at least one of a press-fit tab, a press-fit post, a barb, a screw, a spring, a nail, a staple and a rivet.

The housing 610 also includes three ports 621, 631, 641. Each of the three ports 621, 631, 641 is included as a part of a floating connection assembly that includes a floating connection device and a radial centering mechanism. For example, the first port 621 is provided in combination with a first floating bullet 622 and a first radial centering mechanism 627. Similarly, the second port 631 is provided in combination with a second floating bullet 632 and a second radial centering mechanism 637, and the third port 641 is provided in combination with a third floating bullet 642 and a third radial centering mechanism 647. The radial centering mechanisms 627, 637, 647 are similar to the radial centering mechanism 530 of FIG. 5. Each of the radial centering mechanisms 627, 637, 647 includes a spring or coil sheathed around a portion of a corresponding one of the floating bullets 622, 632, 642.

Additionally and/or alternatively, in some implementations, one or more of the three floating bullets 622, 632, 642 includes a respective bulbous mating end 622*a*, 632*a*, 642*a* configured to be inserted into a corresponding receiving port. In some implementations, one or more of the bulbous mating end 622*a*, 632*a*, 642*a* includes a respective lead-in taper edge 623, 633, 643. The respective lead-in taper edges 623, 633, 643 function to position the corresponding floating bullets 622, 632, 642 into port-to-port alignment when connectors are offset relative to one another in order to facilitate blind mating.

Figure 7C:
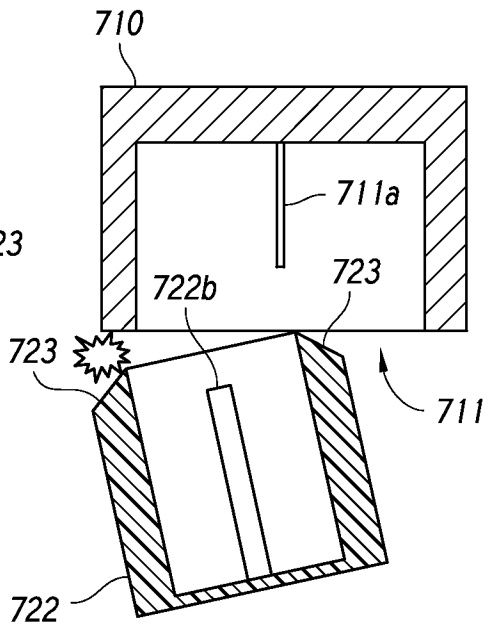
FIGS. 7A-7C are schematic diagrams that illustrate different portions of a mating sequence in accordance with some implementations.
Figure 7B:
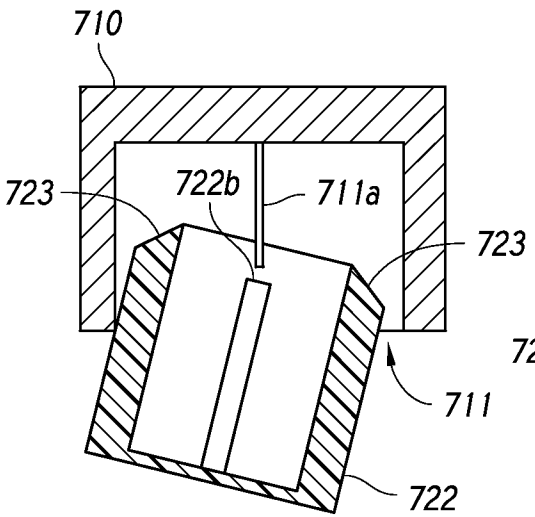
Figure 7A:
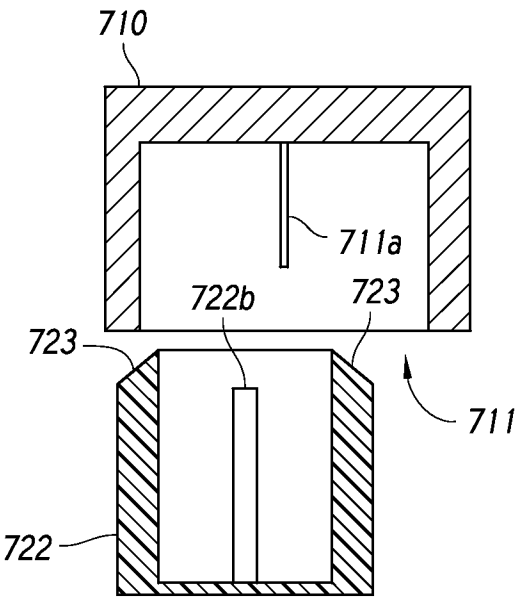

For example, FIGS. 7A-7C, are schematic diagrams that illustrate different portions of a mating sequence in accordance with some implementations. More specifically, FIG. 7A-7C illustrate the mating of a port 711 with a bulbous mating end 722 of a floating bullet. The port 711 is included in a housing 710, and includes a central pin 711*a*. Again, while the housing 710 merely includes a single respective port, those of ordinary skill in the art will appreciate from the present disclosure that in various implementations a housing of a multiport connector includes a plurality of ports. In some implementations, the bulbous mating end 722 also includes a lead-in taper edge 723 provided to position the floating bullets into port-to-port alignment port 711. In some implementations, the bulbous mating end 722 also includes a central connector sheath 722*b* configured to mate with the central pin 711*a* by enveloping the central pin 711.

FIG. 7A shows the port 711 and the bulbous mating end 722 in slight misalignment. As shown in FIG. 7B, during mating of the port, when the lead-in taper edge 726 meets the housing 710 surrounding the port 711, the bevel of the lead-in taper edge 723 tilts the bulbous mating end 722 toward the axial center line, defined by the pin 711*a*, of the port 711. In other words, the lead-in taper edge 723 gathers and repositions the floating bullet to the correct position with respect to the mating interface. However, if as shown in FIG. 7C, the port 711 and the bulbous mating end 722 are too far out of alignment because of excessively free (or loose) radial float, the lead-in taper end 723 may not be sufficient. As such, in accordance with various implementations, a radial centering mechanism is used to correct the alignment in order to reduce excessively free radial float of a floating connection device.

Figure 8:
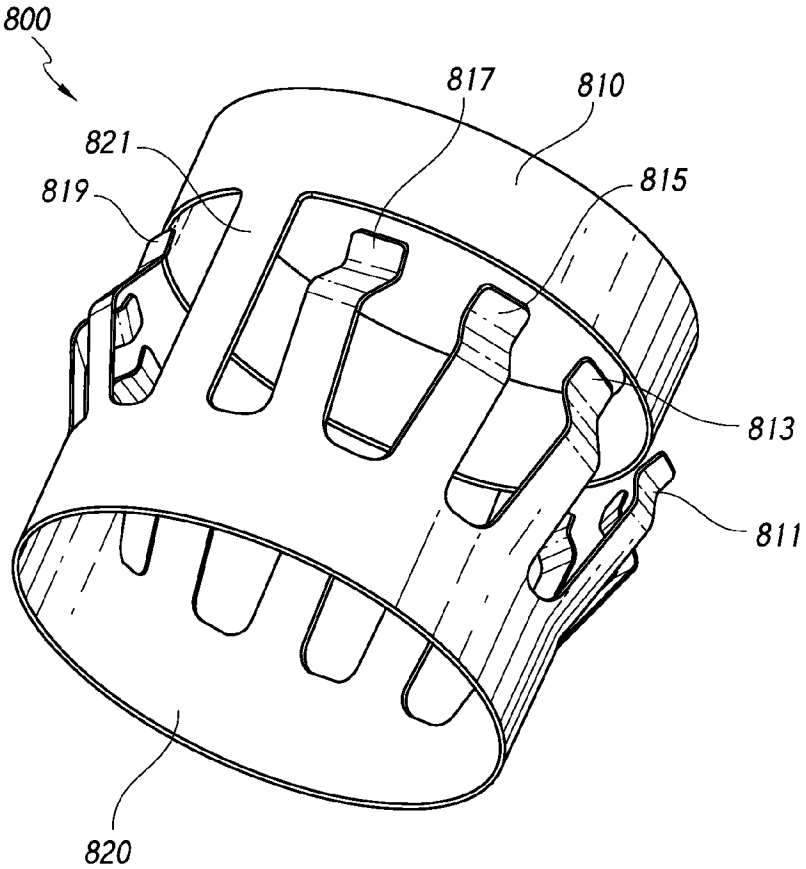
FIG. 8 is a perspective view of a radial spring configured to serve as a radial centering mechanism in accordance with some implementations.

FIG. 8 is a perspective view of a radial spring 800 configured to serve as a radial centering mechanism according to some implementations. In some implementations, the radial spring 800 includes two ring members 810, 820, which are separated by at least one axial portions 821 joining rings 810 820, and flexible axial portions 811, 813, 815, 819. In some implementations, the radial spring 800 is arranged around at least a portion of floating connection device. For example, with reference to FIG. 5, in some implementations, the radial spring 800 is arranged around the axial portion of the floating bullet 422 between the second lip 424 of the floating bullet 422 and the circumferential ridge 428 on the inner sidewall housing of the port 421. In operation, the flexible axial portions 811, 813, 815, 819 flexes in response to a force exerted against a floating connection device (e.g. a floating bullet), and imparts a restorative force that at least partially opposes the force exerted against the floating connection device.

Figure 9:
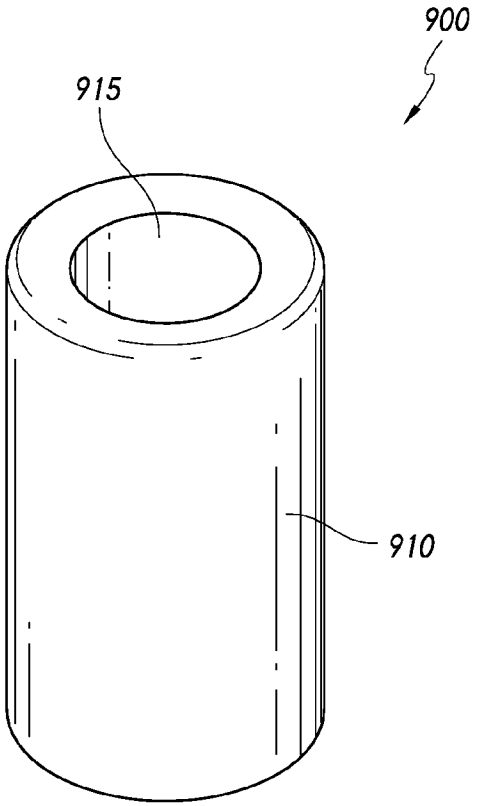
FIG. 9 is a perspective view of a semi-deformable sheath configured to serve as a radial centering mechanism in accordance with some implementations.

FIG. 9 is a perspective view of a semi-deformable sheath 900 configured to serve as a radial centering mechanism in accordance with some implementations. In some implementations, the semi-deformable sheath includes an elongate member characterized by a tubular sidewall 910 and an axial path 915 configured to accept an axial portion of a floating connection device. For example, in some implementations, the semi-deformable sheath 900 includes a silicon (or another suitable material) band that slip fits around an axial portion of a floating connection device. For example, with reference to FIG. 5, in some implementations, the semi-deformable sheath 900 is arranged around the axial portion of the floating bullet 422 between the second lip 424 of the floating bullet 422 and the circumferential ridge 428 on the inner sidewall housing of the port 421. In some implementations, an evaporative lubricant is used to ensure that the semi-deformable sheath 900 fits tightly around an axial portion of the floating connection device. In operation, the semi-deformable sheath 900 flexes in response to a force exerted against a floating connection device, and imparts a restorative force that at least partially opposes the force exerted against the floating connection device.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, which changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. An apparatus comprising:

a plurality of ports included in a housing, wherein at least some of the plurality of ports include respective pin mating receptacles arranged to receive respective conductive pins;

a plurality of floating connection devices, wherein each of the plurality of floating connection devices is partially included within a respective one of the plurality of ports, is partially protruding from the respective one of the plurality of ports, and is arranged to radially float around a corresponding axial center line of the respective one of the plurality of ports; and a plurality of radial centering mechanisms, wherein each of the plurality of radial centering mechanisms is arranged to surround one or more outside portions of a corresponding one of the plurality of floating connection devices against one or more inside portions of the respective one of the plurality of ports, each of the plurality of radial centering mechanisms configured to bias the corresponding one of the plurality of floating connection devices towards the corresponding axial center line of the respective one of the plurality of ports.

2. The apparatus of claim 1, wherein a number of the plurality of floating connection devices is equal to the number of the plurality of ports.

3. The apparatus of claim 1, further comprising:

wherein each floating connection device includes a lip surrounding one or more outside portions thereof;

wherein each port includes a ridge protruding inward from one or more inside portions thereof; and wherein each floating connecting device is anchored to a respective port by engagement of the lip of the floating connection device with the ridge of the respective port.

4. The apparatus of claim 1, wherein at least one of the plurality of radial centering mechanisms is configured to impart a substantially balanced axial force in order to bias the corresponding one of the plurality of floating connection devices.

5. The apparatus of claim 1, wherein at least one of the plurality of radial centering mechanisms is configured to impart a substantially radial force to the floating connection device in order to bias the corresponding one of the plurality of floating connection devices.

6. The apparatus of claim 1, wherein at least one of the plurality of floating connection devices comprising a floating bullet.

7. The apparatus of claim 6, wherein the floating bullet includes an end characterized by a lead-in tapered edge.

8. The apparatus of claim 1, wherein the housing is included in a first multiport connector, and wherein the apparatus further comprises:

a substrate including a surface; and a second multiport connector coupled to the substrate, and wherein the first and second multiport connectors are rigidly fixed relative to one another using the substrate.

9. The apparatus of claim 8, wherein the substrate includes at least one of a printed circuit board, a backplane and a port mounting plate.

10. The apparatus of claim 1, wherein each radial centering mechanism comprises a radial spring which includes a ring member and a plurality of flexible axial portions extending from the ring member.

11. The apparatus of claim 10, further comprising a fastener, wherein the fastener includes at least one of a press-fit tab, a press-fit post, a barb, a screw, a spring, a nail, a staple and a rivet.

12. An apparatus comprising:

a port having a sidewall defined path and an axis substantially centered within the sidewall defined path;

a floating connection device partially included within the port, partially protruding from the port to mate within a receiving port, and arranged to radially float around the axis of the port; and a radial centering mechanism arranged to surround one or more outside portions of the floating connection device against one or more inside portions of the port, the radial centering mechanism imparting a substantially radial force that biases the floating connection device towards the axis of the port, wherein the radial centering mechanism includes a deformable O-ring.

13. The apparatus of claim 12, further comprising:

wherein the floating connection device comprises a floating bullet;

wherein the floating connection device includes a lip surrounding one or more outside portions thereof;

wherein the port includes a ridge protruding inward from one or more inside portions thereof; and wherein the floating connecting device is anchored to the port by engagement of the lip of the floating connection device with the ridge of the port.

14. The apparatus of claim 13, wherein the floating bullet includes an end characterized by a lead-in tapered edge.

15. The apparatus of claim 12, wherein the radial centering mechanism comprises a radial spring which includes a ring member and a plurality of flexible axial portions extending from the ring member.

16. The apparatus of claim 15, wherein the radial centering mechanism includes a spring or a semi-rigid deformable sheath surrounding a portion of the floating connection device.

* * * * *